US008418970B2

(12) United States Patent
Foan

(10) Patent No.: US 8,418,970 B2
(45) Date of Patent: Apr. 16, 2013

(54) SWING NOSE CROSSING

(75) Inventor: Andrew Raymond Foan, Nottingham (GB)

(73) Assignee: Progress Rail Services Corp, Albertville, AL (US)

( * ) Notice: Subject to any disclaimer, the term of this patent is extended or adjusted under 35 U.S.C. 154(b) by 288 days.

(21) Appl. No.: 12/866,884

(22) PCT Filed: Feb. 11, 2009

(86) PCT No.: PCT/GB2009/050133

§ 371 (c)(1),
(2), (4) Date: Nov. 9, 2010

(87) PCT Pub. No.: WO2009/101438

PCT Pub. Date: Aug. 20, 2009

(65) Prior Publication Data

US 2011/0042527 A1 Feb. 24, 2011

(30) Foreign Application Priority Data

Feb. 11, 2008 (GB) ..... 0802495.2

(51) Int. Cl.
*E01B 7/14* (2006.01)

(52) U.S. Cl.
USPC ..... 246/465; 246/468; 246/472; 246/454; 246/435 R

(58) Field of Classification Search ..... 246/264, 246/382, 385, 460, 461, 391, 415 R, 448, 246/452, 455, 456, 458, 463, 464, 465, 468, 246/470, 472, 454, 435 R
See application file for complete search history.

(56) References Cited

U.S. PATENT DOCUMENTS

| | | | | |
|---|---|---|---|---|
| 2,036,198 | A | 4/1936 | Cooper et al. | |
| 5,598,993 | A * | 2/1997 | Kuhn et al. | 246/468 |
| 7,740,208 | B2 * | 6/2010 | Mugg | 246/435 R |

FOREIGN PATENT DOCUMENTS

| | | |
|---|---|---|
| EP | 0838 552 A1 | 4/1998 |
| EP | 1 020 562 A1 | 7/2000 |

* cited by examiner

*Primary Examiner* — Mark Le
(74) *Attorney, Agent, or Firm* — Finnegan, Henderson, Farabow, Garrett & Dunner LLP

(57) ABSTRACT

A swing nose crossing has the swing nose housed in an insert component which itself is mounted within the wing rails of the swing nose crossing. The cradle provides the lateral faces against which the swing nose abuts.

20 Claims, 4 Drawing Sheets

SWING NOSE CROSSING

This is a non-provisional application claiming the benefit of International application number PCT/GB2009/050133 filed Feb. 11, 2009.

TECHNICAL FIELD

This disclosure relates to a swing nose crossing for use in a railway system.

BACKGROUND

A crossing of railway tracks can be achieved with no moving parts if a wheel is allowed to ride over a gap where the rail paths cross. To provide continuous support of a wheel as it passes through a crossing, a swing nose crossing is conventionally used. This uses a movable pair of rails which form a so-called "swing nose", which is a V shaped connection of two rails which taper to a point. The outer edges of the V shape define two possible rail paths, and the position of the swing nose is set to the rail path currently in use.

The swing nose is made from rails which are cut to appropriate length and machined to a taper along a large proportion of length to form a very narrow toe at the joined end. In this way, when seated snugly against one or other lateral supporting rails, the swing nose does not bring the gauge of the track out of tolerance.

A problem with this arrangement is that the swing nose is prone to wear. In addition, some swing nose crossing designs are not suitable for heavy freight.

SUMMARY

The present disclosure is directed to a railway track crossing configuration. The configuration comprises first and second rails on one side of the crossing. The configuration also comprises third and fourth rails on the other side of the crossing. The third and fourth rails are joined at a laterally movable tapered swing nose, wherein the swing nose is movable between a first position in which a substantially continuous path is defined between the first and third rails, and a second position in which a substantially continuous path is defined between the second and fourth rails. The configuration further comprises a pair of outer rail portions which provide lateral support for the lateral movement of the swing nose. The configuration further comprises a cradle which comprises opposite lateral faces against which the swing nose abuts in its first and second positions, the cradle being housed inside the outer rail portions.

The use of a cradle in accordance with the disclosure enables a strong support to be provided to the wheels through the transfer zone, and it does not require flash butt welding. The cradle can be designed so that the outer rail portions wrap around the cradle so that the cradle is securely held in position.

The outer rail portions can comprise wing rails of the same design as the main stock rails used in the track system.

The cradle may comprise an insert having outer faces with a shape matching the outer rail portion side profiles. This provides a secure enclosure for the cradle.

The cradle may have inner faces which at the top match the shape of the top of the sides of the swing nose. In this way, the cradle and the swing nose together define the support surface for the rail vehicle wheel as it transfers across the crossing.

The cradle may be a cast component, for example an alloy such as manganese steel and chrome. Base plates can be used for mounting the outer rail portions to a supporting structure.

BRIEF DESCRIPTION OF THE DRAWINGS

The disclosure will now be further described by way of example with reference to the accompanying figures in which.

DETAILED DESCRIPTION

The disclosure provides a swing nose crossing in which the swing nose is housed in an insert component which itself is mounted within the wing rails of the swing nose crossing. The cradle provides the lateral faces against which the swing nose abuts.

Figure 1:
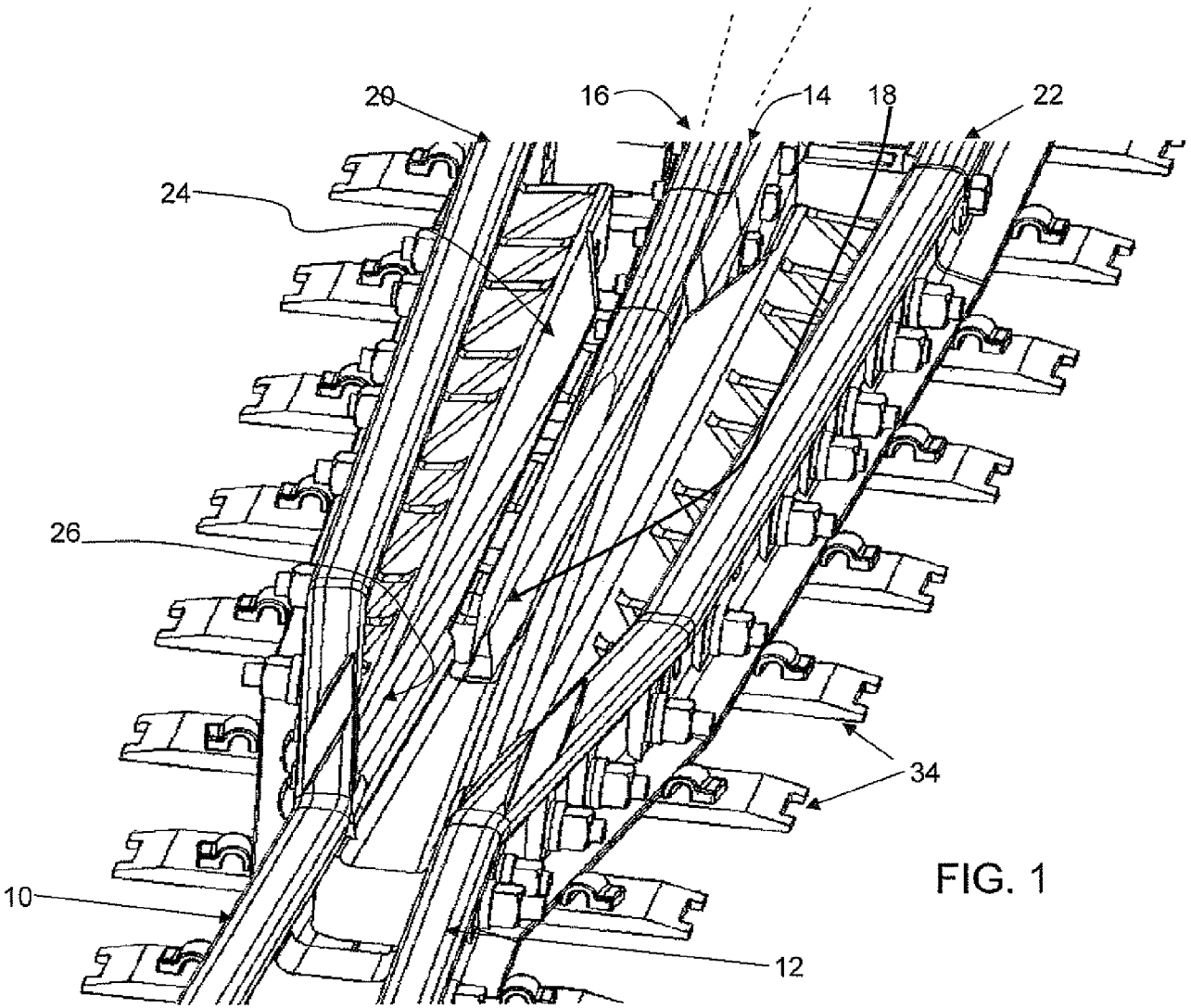
FIG. 1 shows a swing nose crossing arrangement of the disclosure.

FIG. 1 shows a swing nose crossing arrangement of the disclosure.

For a turnout, one swing nose arrangement such as in FIG. 1 is required. For a crossover, one of the arrangements of FIG. 1 is for one side of the track, and another arrangement will be provided on the other side. The configuration of FIG. 1 comprises first and second rails 10,12 on one side of the crossing, and third and fourth rails 14,16 on the other side of the crossing. The third and fourth 14,16 rails are joined at a laterally movable tapered swing nose 18.

In FIG. 1, only the swing nose of the rails 14,16 is shown, up to the point where the rails 14,16 start to diverge. Further away from the crossing, the rails 14,16 become separate.

The swing nose 18 is movable between a first position in which a substantially continuous path is defined between the first and third rails 10,14, and a second position in which a substantially continuous path is defined between the second and fourth rails 12,16. The first position of the swing nose is shown schematically in plan view in FIG. 2. Thus, in the arrangement shown in FIG. 2, there is a continuous path so that the rail vehicle can travel between rails 10 and 14.

A pair of outer rail portions 20, 22 provides lateral support for the lateral movement of the swing nose 18. These are portions of wing rails. They terminate at the end of the swing nose crossing and do not carry rail traffic.

In accordance with the disclosure, the configuration further comprises a cradle 24 which comprises opposite lateral faces against which the swing nose 18 abuts in its first and second positions. The cradle 24 is housed inside the outer rail portions 20, 22.

Figure 2:
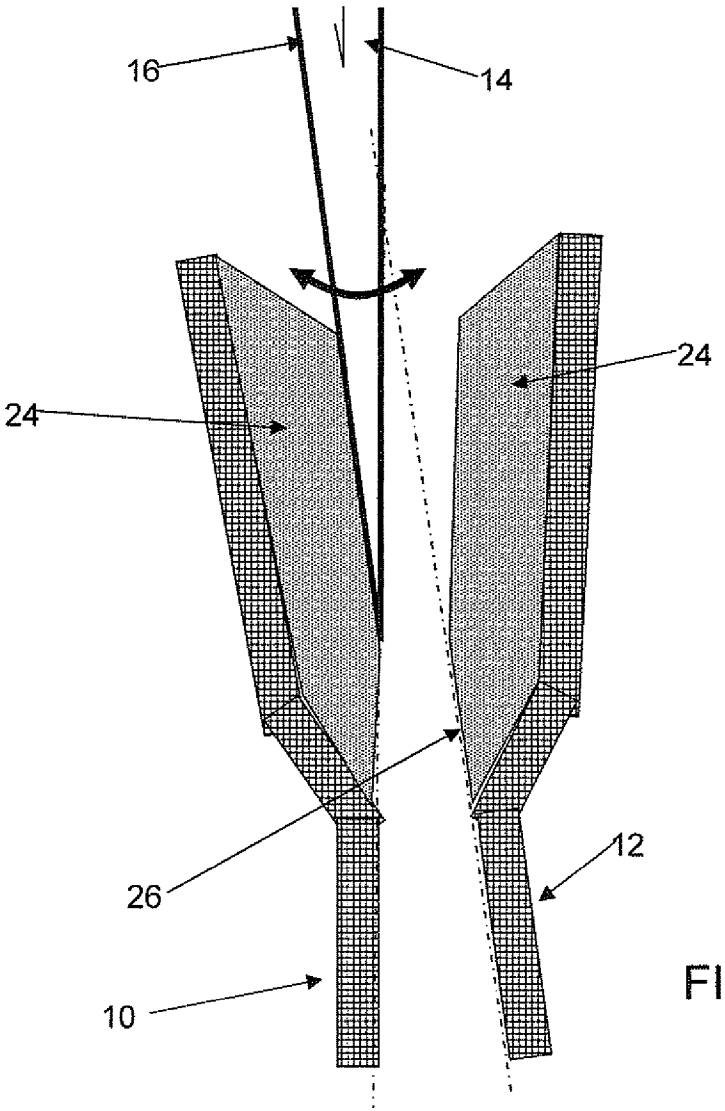
FIG. 2 shows the swing nose in one position for the purposes of explanation.

The cradle enables a strong support to be provided to the wheels through the transfer zone. As can be seen in FIGS. 1 and 2, part of the rail support is provided by the cradle, at location 26.

The outer rail portions 20,22 wrap around the cradle 24 so that the cradle is securely held in position.

Figure 3:
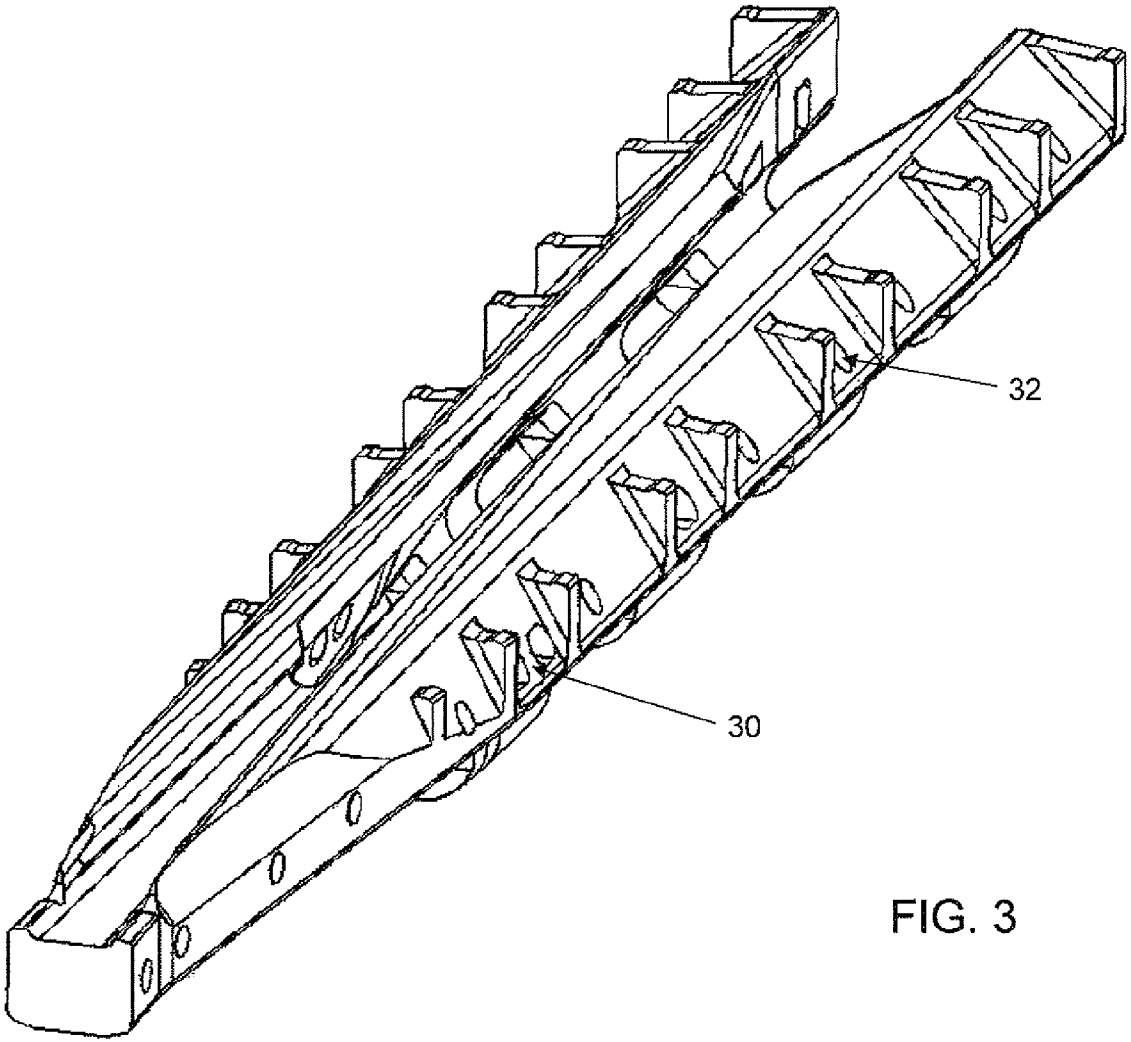
FIG. 3 shows the cradle part of the arrangement of FIG. 1 in more detail.

The cradle is shown in more detail in FIG. 3, and comprises an insert having outer faces with a shape matching the side profiles of the outer rail portions 20,22. This provides a secure enclosure for the cradle. As shown, the outer faces of the insert do not need to be a continuous surface matching the outer wing rails (although this is an option). In FIG. 3, it can be seen that the contact with the wing rails is defined by a series of ribs. As shown in FIG. 3, the ribs can be angular ribs.

Inner faces of the cradle 24 match the shape of the top of the sides of the swing nose. In this way, the cradle and the swing nose together define the support surface for the rail vehicle wheel as it transfers across the crossing.

FIG. 3 shows a mounting part 30 for a drive mechanism to pass through to the swing nose and also mounting points 32 for connecting the cradle to the outer stock rails.

The cradle can be a cast component, for example an alloy such as manganese steel and chrome. This gives a rapid work hardening, avoiding the need for pre-hardening.

Base plates 34 shown in FIG. 1 are used for mounting the outer rail portions to a supporting structure, such as concrete slab or rail bearers with ballast.

Figure 4:
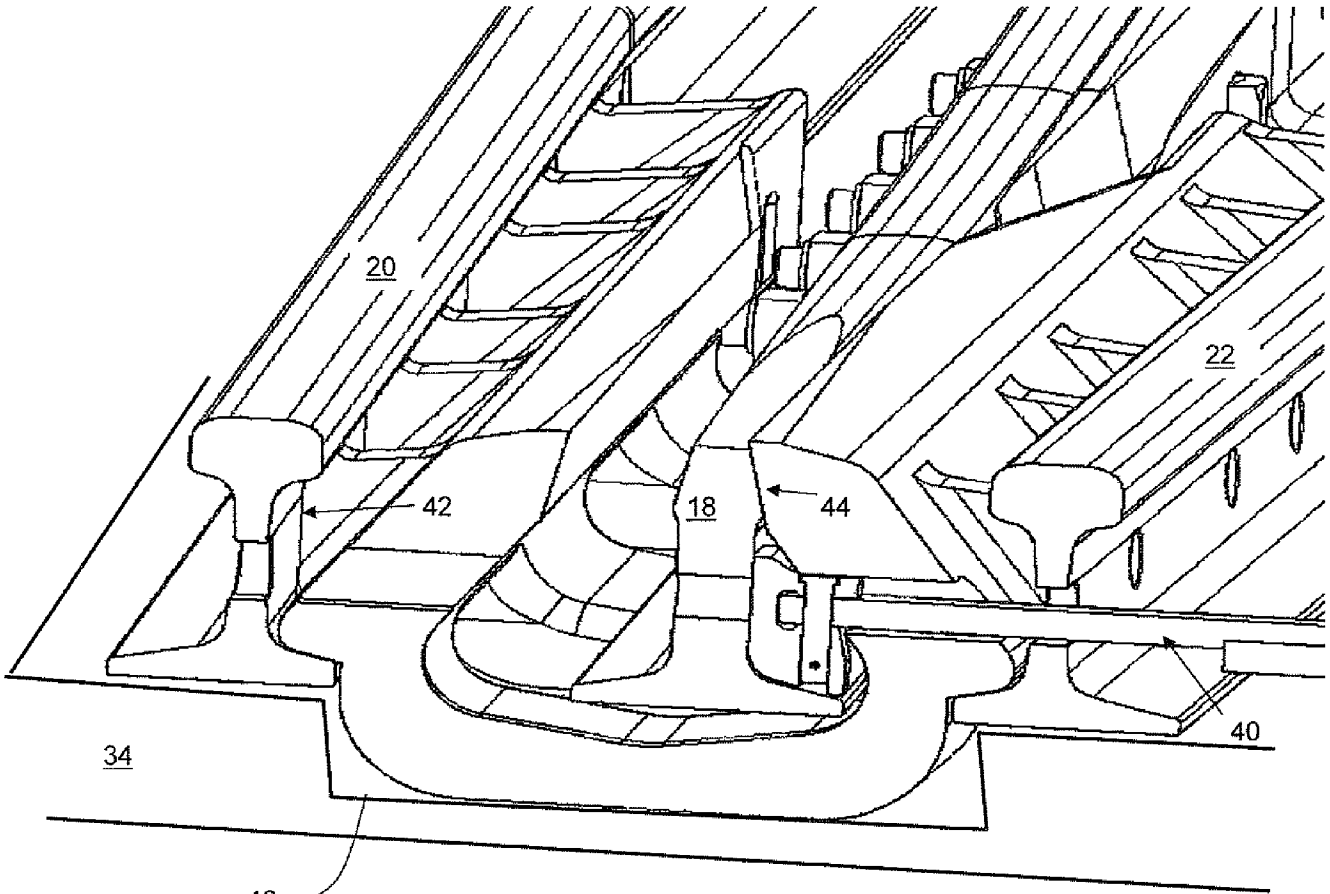
FIG. 4 is a cross section through the arrangement to assist in the explanation of the components used.

FIG. 4 is a cross section through the arrangement at the location of the drive mechanism 40 for the swing nose. Any conventional drive mechanism can be used, to pull/push the swing nose against the opposite inner faces of the cradle. A control rod is shown in FIG. 4. FIG. 4 shows more clearly the way the outer face 42 of the cradle matches the shape of the rail side profile, and the way the top of the inside face 44 of the cradle matches the shape of the swing nose top part.

FIG. 4 also shows a cross section through the base plate 34, which clamps the stock rail portions 20,22 as well as providing a secure seating for the cradle—in a well 46 as shown.

The swing nose crossing sits between main rails. When set for example for the right direction the left wheels are on the swing nose crossing and the right wheel are on a plain rail.

INDUSTRIAL APPLICABILITY

The railway track system according to the disclosure can be used in high speed applications, for example in which the wing rails are non-grooved rails, such as UIC60 flat bottom rails. It can be used on heavy freight applications, in which the arrangement confers superior strength, for example using flat bottomed 136RE rails.

As mentioned above, the swing nose crossing can be used for crossovers and turnouts. Only one design of cradle has been shown, but many different designs are possible. Preferably, the cradle is one-piece but this is not essential. It acts as a spacer with inside faces matching the swing nose profile and outer faces matching the wing rail side profile (which can be the same profile as the stock rails). The cradle is bolted to the wing rails in the example shown, but it could be designed to be fixed differently, for example clamped or bolted to the baseplate.

Various modifications will be apparent to those skilled in the art.

The invention claimed is:

1. A railway track crossing configuration comprising:

first and second rails on one side of the crossing;

third and fourth rails on the other side of the crossing, wherein the third and fourth rails are joined at a laterally movable tapered swing nose, wherein the swing nose is movable between a first position in which a substantially continuous path is defined between the first and third rails, and a second position in which a substantially continuous path is defined between the second and fourth rails; and a pair of outer rail portions which provide lateral support for the lateral movement of the swing nose, wherein the configuration further comprises a cradle which comprises opposite lateral faces against which the swing nose abuts in its first and second positions, the cradle being housed inside the outer rail portions, wherein the cradle includes a plurality of lateral, angular ribs spaced along a length of the cradle and on outer surfaces of the cradle.

2. A configuration as claimed in claim 1, wherein the outer rail portions comprise wing rails.

3. A configuration as claimed in claim 1, wherein the cradle comprises an insert having outer faces with a shape matching outer rail portion side profiles.

4. A configuration as claimed in claim 1, wherein the cradle has inner faces which at a top match a shape of a top of sides of the swing nose.

5. A configuration as claimed in claim 1, further comprising a drive mechanism for moving the swing nose between the first and second positions.

6. A configuration as claimed in claim 1, wherein the cradle is a cast component.

7. A configuration as claimed in claim 1, wherein the cradle is made from an alloy.

8. A configuration as claimed in claim 7, wherein the alloy is of manganese steel and chrome.

9. A configuration as claimed in claim 1, further comprising base plates for mounting the outer rail portions to a supporting structure.

10. A railway track crossing configuration comprising:

first and second rails on one side of the crossing;

third and fourth rails on the other side of the crossing, wherein the third and fourth rails are joined at a laterally movable tapered swing nose, wherein the swing nose is movable between a first position in which a substantially continuous path is defined between the first and third rails, and a second position in which a substantially continuous path is defined between the second and fourth rails; and a pair of outer rail portions which provide lateral support for the lateral movement of the swing nose, the outer rail portions comprising wing rails, wherein the configuration further comprises a cradle which comprises opposite lateral faces against which the swing nose abuts in its first and second positions, the cradle being housed inside the outer rail portions, wherein outer faces of the cradle define a plurality of angular ribs that contact the wing rails and are spaced along a length of the cradle.

11. A configuration as claimed in claim 10, wherein the cradle includes a mounting port configured to receive a drive mechanism to move the swing nose.

12. A configuration as claimed in claim 11, further comprising a drive mechanism for moving the swing nose between the first and second positions.

13. A configuration as claimed in claim 10, wherein the cradle is a cast component.

14. A configuration as claimed in claim 10, wherein the cradle is made from an alloy.

15. A configuration as claimed in claim 10, further comprising base plates for mounting the outer rail portions to a supporting structure.

16. A configuration as claimed in claim 10, wherein the cradle has a "U" shaped cross-section.

17. A configuration as claimed in claim 16, wherein a lower portion of the "U" shaped cross-section extends below a bottommost surface of the pair of outer rail portions.

18. A railway track crossing configuration comprising:

first and second rails on one side of the crossing;

third and fourth rails on the other side of the crossing, wherein the third and fourth rails are joined at a laterally movable tapered swing nose, wherein the swing nose is movable between a first position in which a substantially continuous path is defined between the first and third rails, and a second position in which a substantially continuous path is defined between the second and fourth rails; and a pair of outer rail portions which provide lateral support for the lateral movement of the swing nose, wherein the configuration further comprises a cradle which comprises opposite lateral faces against which the swing nose abuts in its first and second positions, the cradle being housed inside the outer rail portions, wherein the cradle extends below a bottommost surface of the pair of outer rail portions.

19. A configuration as claimed in claim 18, wherein outer faces of the cradle define a plurality of lateral ribs.

20. A configuration as claimed in claim 18, wherein the cradle includes a mounting port configured to receive a drive mechanism to move the swing nose.

* * * * *